United States Patent [19]

Hosokawa et al.

[11] Patent Number: 5,064,304

[45] Date of Patent: Nov. 12, 1991

[54] PRINTER HAVING AN INK RIBBON SHIFT APPARATUS

[75] Inventors: Yoshiaki Hosokawa; Masaki Kanoh; Takashi Maekawa; Hirofumi Nakayasu, all of Kawasaki, Japan

[73] Assignee: Fujitsu Limited, Kawasaki, Japan

[21] Appl. No.: 652,377

[22] Filed: Feb. 7, 1991

Related U.S. Application Data

[63] Continuation of Ser. No. 491,170, Mar. 9, 1990, abandoned.

[30] Foreign Application Priority Data

Mar. 10, 1989 [JP] Japan ..... 1-59445

[51] Int. Cl.[5] ..... B41J 33/14

[52] U.S. Cl. ..... 400/225; 400/208; 400/240.4; 400/248

[58] Field of Search ..... 400/194–196.1, 400/207, 208, 208.1, 214, 216.1, 217, 223, 225, 227.2, 240, 240.1, 240.4, 248

[56] References Cited

U.S. PATENT DOCUMENTS

| | | | |
|---|---|---|---|
| 3,513,957 | 5/1970 | Ricciardi et al. | 400/248 |
| 4,423,973 | 1/1984 | Theilen | 400/248 |
| 4,462,707 | 7/1984 | Fallonieri | 400/225 |
| 4,469,458 | 9/1984 | Giolitti | 400/208 |
| 4,630,951 | 12/1986 | Nii | 400/697 |
| 4,636,098 | 1/1987 | Halter et al. | 400/225 |
| 4,637,744 | 1/1987 | Valle et al. | 400/208 |
| 4,650,355 | 3/1987 | Cassiano et al. | 400/208 |
| 4,652,154 | 3/1987 | Horiya et al. | 400/225 |
| 4,695,175 | 9/1987 | Tsukada et al. | 400/225 |
| 4,712,931 | 12/1987 | Ohshima | 400/225 |
| 4,944,618 | 7/1990 | Ideta | 400/225 |

FOREIGN PATENT DOCUMENTS

| | | | |
|---|---|---|---|
| 0158963 | 10/1985 | European Pat. Off. . | |
| 2930127 | 2/1981 | Fed. Rep. of Germany | 400/208 |
| 3403928 | 8/1985 | Fed. Rep. of Germany | 400/208 |
| 0152893 | 7/1987 | Japan | 400/636.1 |
| 2199307 | 7/1988 | United Kingdom . | |

OTHER PUBLICATIONS

Patent Abstracts of Japan, vol. 11, No. 14 (M-553)(2461), Jan. 14, 1987; & JP-A-61189983 (Tokyo Electric) 23/08/1986.

*Primary Examiner*—Eugene H. Eickholt
*Attorney, Agent, or Firm*—Staas & Halsey

[57] ABSTRACT

A printer having an ink ribbon shift apparatus includes a carrier unit having a printer head and a ribbon guide which is movable upwardly and downwardly. Up and down shift means are provided to shift an ink ribbon cassette up and down. A shaft is disposed parallel to a platen and extends along the entire range of movement of the carrier unit. The shaft shifts up and down together with the ink ribbon cassette and is engaged with the said ribbon guide. The up and down shift means moves the ink ribbon cassette up and down and the ribbon guide is thereby shifted up and down via the shaft so that a predetermined color band of an ink ribbon is positioned on a printing line.

5 Claims, 8 Drawing Sheets

PRINTER HAVING AN INK RIBBON SHIFT APPARATUS

This application is a continuation of application Ser. No. 07/491,170, filed Mar. 9, 1990, now abandoned.

Background of the Invention

The present invention relates to a printer having an ink ribbon apparatus, and more particularly, to a printer using a ribbon cassette having a color ink ribbon with a plural number of bands of different colors.

In an impact printer such as a wire dot printer and the like, a color ink ribbon that is divided across its width into bands of different colors is used in order to perform color printing.

Color printing using such a color ink ribbon requires that the area of the color ink ribbon having the desired color be positioned above the printing line on the platen, and therefore requires an ink ribbon shift mechanism to do this.

As a conventional ink ribbon shift mechanism, for example, U.S. Pat. No. 4,695,175, discloses a mechanism wherein a rotation mechanism swings an ink ribbon cassette, which in turn causes a lever on a carriage to rotate thereby to move a ribbon guide up and down.

In such a mechanism, the ribbon frame and the lever are connected by a connecting mechanism, which is adapted to keep the rotational position of the lever as it is while the carridge moves along the platen.

Also, West German Patent Laid Open Pubilication No. 3,538,761 discloses another conventional ink ribbon shift mechanism. This is a mechanism in which an ink ribbon cassette can swing around a single support point, where a ribbon guide can rotate around a separate support point, and where a cam mechanism having first cam members for the ink ribbon cassette and second cam members for the ribbon guide is provided parallel to a platen. The first cam members move the ink ribbon cassette and the second cam members move the ribbon guide separately.

In the mechanism disclosed in U.S. Pat. No. 4,695,175, however, the lever on the carriage and the connecting mechanism cause the problems of the mechanism becoming complex and of there being many places for adjustment.

In the apparatus disclosed in West German Patent Laid Open Publication No. 3,538,761, the second cam members must be adapted to move together with the carridge along the platen and so the mechanism becomes complex and adjustment also becomes difficult.

SUMMARY OF THE INVENTION

Accordingly, it is a general object of the present invention to provide a novel and useful printer having an ink ribbon shift mechanism in which the problems described heretofore are eliminated.

Another object of the present invention is to provide a printer having an ink ribbon shift mechanism with a configuration wherein a shaft engaged with a ribbon guide is provided parallel to a platen so that the up and down movement of the ribbon cassette also moves the shaft up and down, which in turn moves the ribbon guide up and down.

According to the present invention, because the ribbon guide is almost directly moved up and down according to the up and down movement of the ribbon cassette, and because the ribbon guide has the position to which it is moved and held by only the shaft, the number of parts is reduced and the mechanism and its adjustment become simple.

Other objects and further features of the present invention will be apparent from the following detailed description when read in conjunction with the accompanying drawings.

BRIEF DESCRIPTION OF THE INVENTION

DESCRIPTION OF THE PREFERRED EMBODIMENTS

Figure 1:
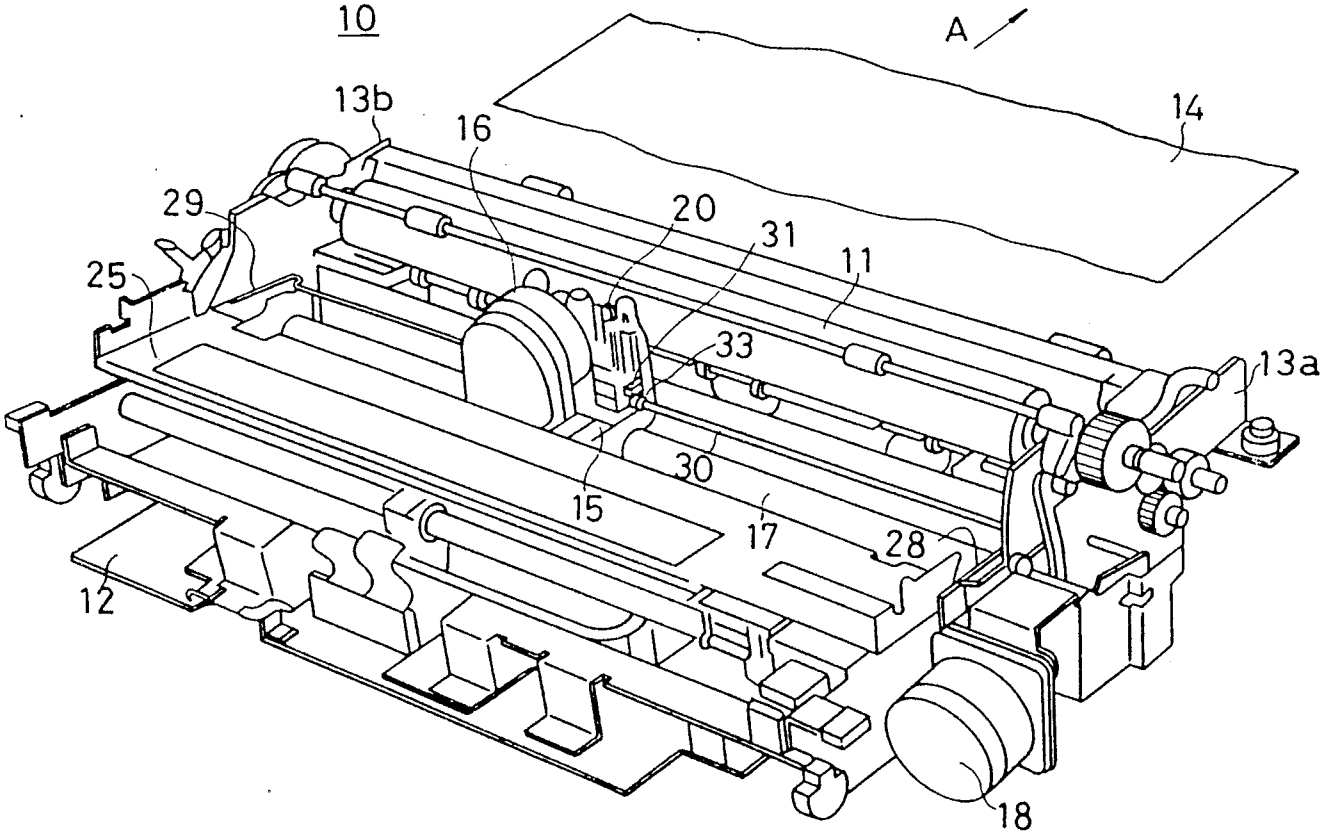
FIG. 1 is a perspective view of one embodiment of a printer according to the present invention.
Figure 2:
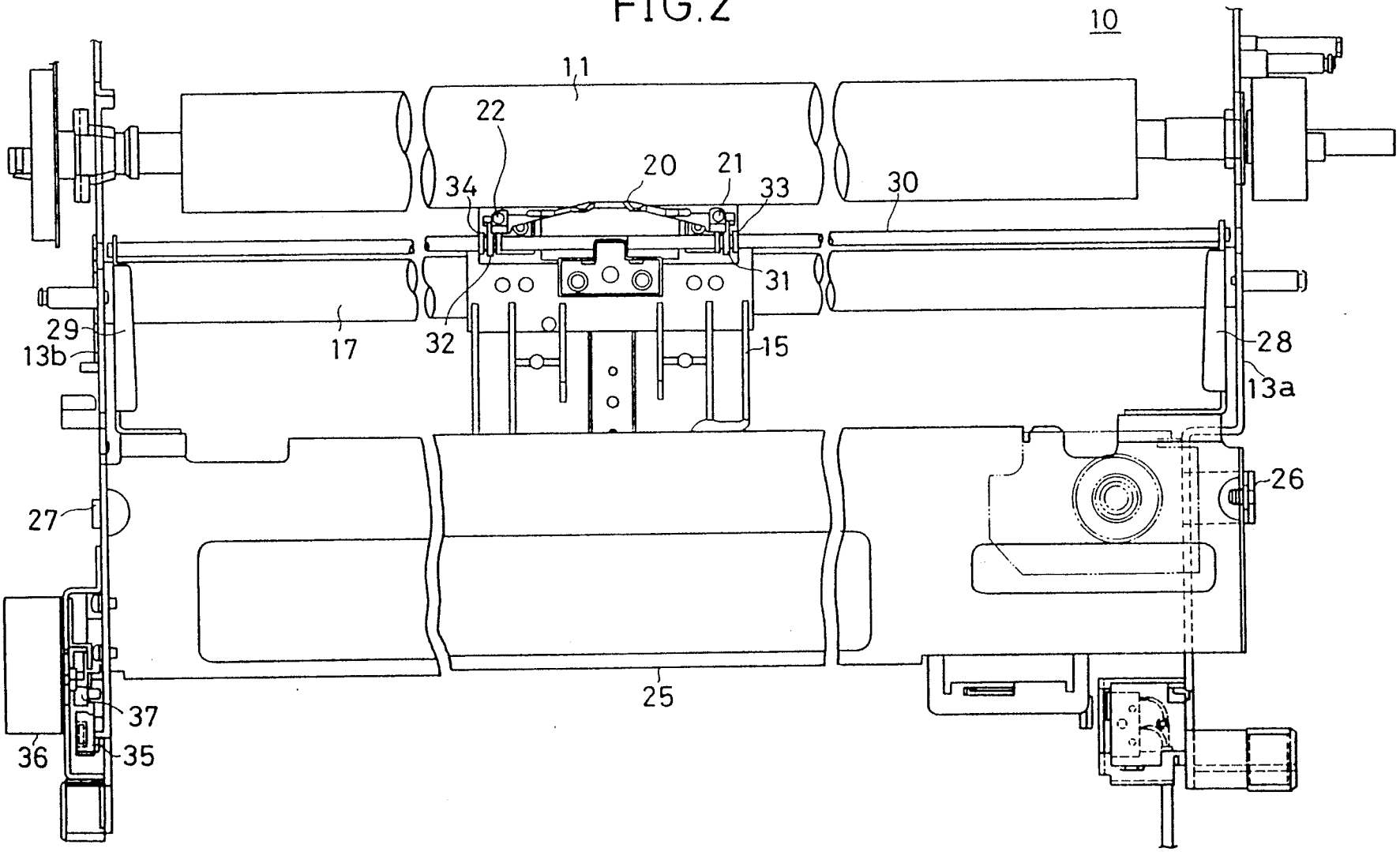
FIG. 2 is a top plan view of the printer of FIG. 1, with the printing head removed.
Figure 3:
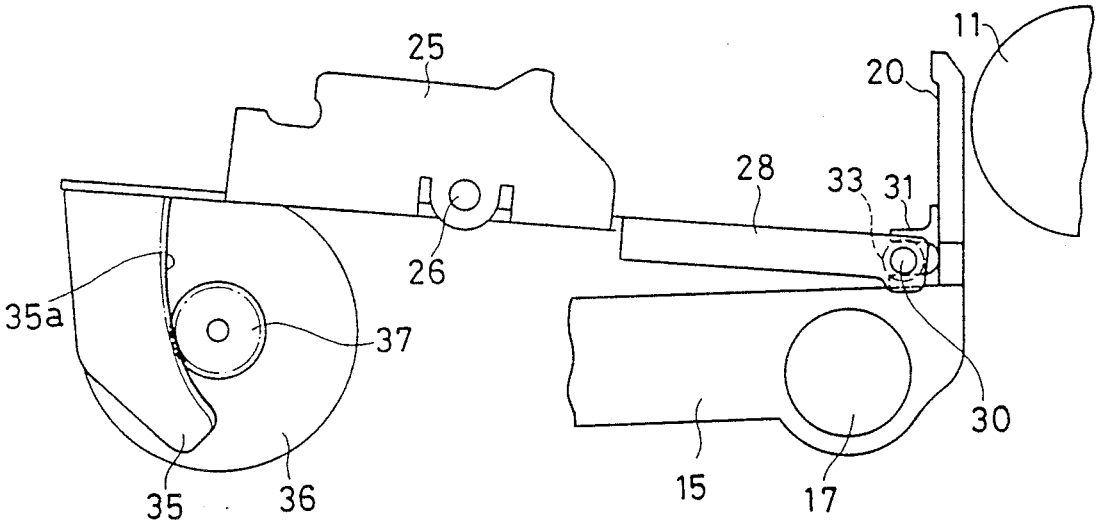
FIG. 3 is schematic side elevational view of the printer of FIG. 2.

FIG. 1, FIG. 2 and FIG. 3 indicate a schematic configuration of a printer 10 according to the present invention.

A rotatable platen 11 is provided between side plates 13*a* and 13*b* at the right and left of a base unit 12. The platen 11 is rotated by a feed mechanism (not indicated in the figure) and feeds printing paper 14 in the direction indicated by the arrow A.

A carrier unit 15 carries a printing head 16 and is supported by a guide shaft 17 provided between the side plates 13*a* and 13*b* so as to be movable therealong. A carrier unit drive mechanism 18 drives the carrier unit 15 in a reciprocating manner in the longitudinal direction of the platen 11.

A ribbon guide 20 engages with and is supported by studs 21 and 22 provided upright in the carrier unit 15, and is movable up and down. The ribbon guide 20 guides the ink ribbon of the ink ribbon cassette to be described later.

Towards the rear side of the carrier unit 15, an ink ribbon cassette support frame 25 is supported so as to be swingable about pivot pins 26, 27 on the side plates 13*a* and 13*b*.

The frame 25 has, at the right and left sides thereof, arm portions 28 and 29 which extend forwardly. Between the ends of these arm portions 28 and 29 is provided a shaft 30 parallel to the platen 11.

On both sides of the lower side portion of the ribbon guide 20, are provided U-shaped cutout portions or brackets 31 and 32 opening so as to face the frame 25. Sleeves 33 and 34 made of synthetic resin are engaged with and held in the cutout portions 31 and 32, and the shaft 30 passes through these sleeves 33 and 34.

The ribbon guide 20 and the shaft 30 are thereby in a mechanical relationship such that they are not restricted in the longitudinal direction of the shaft 30 but are restricted with each other in the up and down direction.

Accordingly, with respect to the up and down shift of the shaft 30, the ribbon guide 20 is shifted together with the shaft 30 in the up and down direction. In addition, the ribbon guide 20 moves along the entire length of the platen 11 together with the carrier unit 15 while its height position is regulated by the shaft 30.

To the rear side of the frame 25 is provided an arm part 35 having a gear portion 35*a*.

A stepping motor 36 is provided on the side plate 13*b* and a gear 37 on its spindle engages with said gear portion 35*a*.

Figure 4:
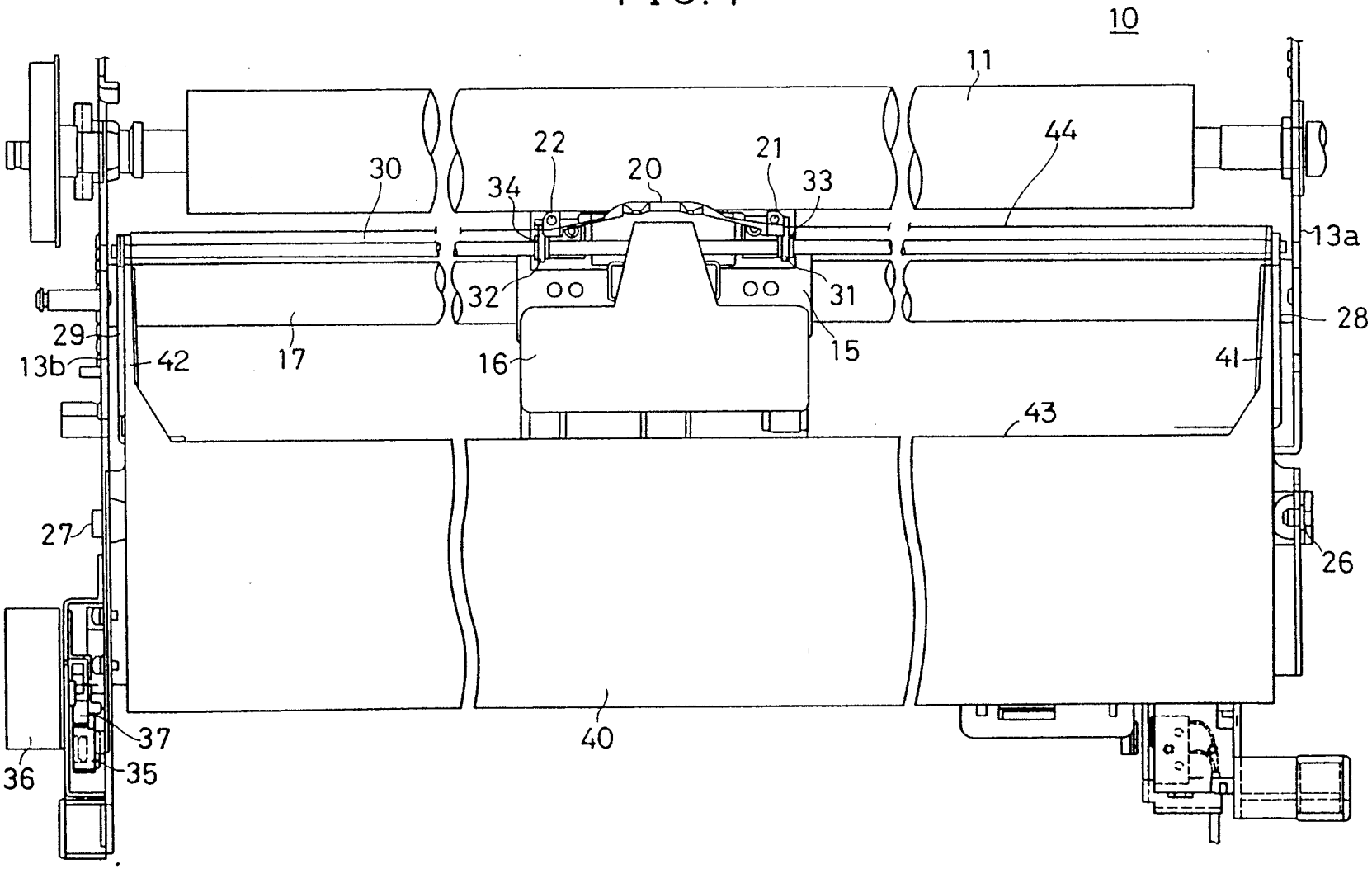
FIG. 4 is a top plan view indicating an ink ribbon cassette loaded in the printer.
Figure 5:
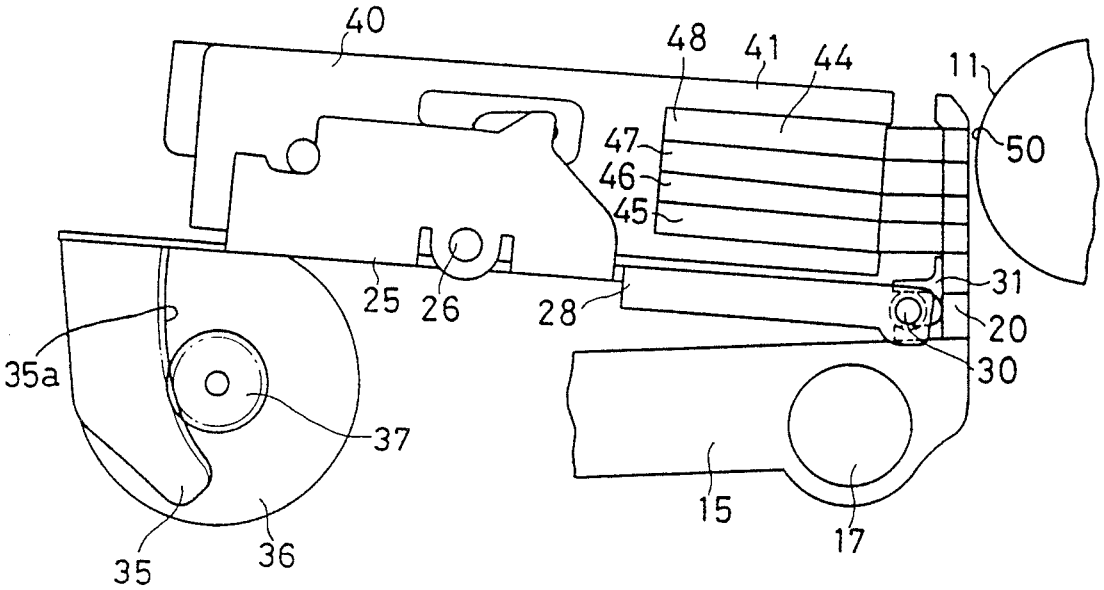
FIG. 5 is side elevational view indicating the ink ribbon cassette loaded in the printer.

As is indicated in FIG. 4 and in FIG. 5, an ink ribbon cassette 40 is loaded on the frame 25.

The ink ribbon cassette 40 has a configuration in which an ink ribbon 44 is accommodated in a cassette unit 43 having arm poritions 41 and 42 on both sides thereof, and a part of the ink ribbon 44 extends in a loop between the arm portions 41 and 42.

When the ink ribbon cassette 40 is loaded on the frame 25, the ink ribbon 44 is parallel to the platen 11 and at the position of the carrier unit 15, is positioned between the printing head 16 and the platen 11 and is guided by the ribbon guide 20.

As indicated in FIG. 5, the ink ribbon 44 has in the order from bottom to top across its width, a yellow band 45, a magenta band 46, a cyan band 47 and a black band 48.

The following is a description of the operation of an apparatus having the configuration described above.

Figure 6:
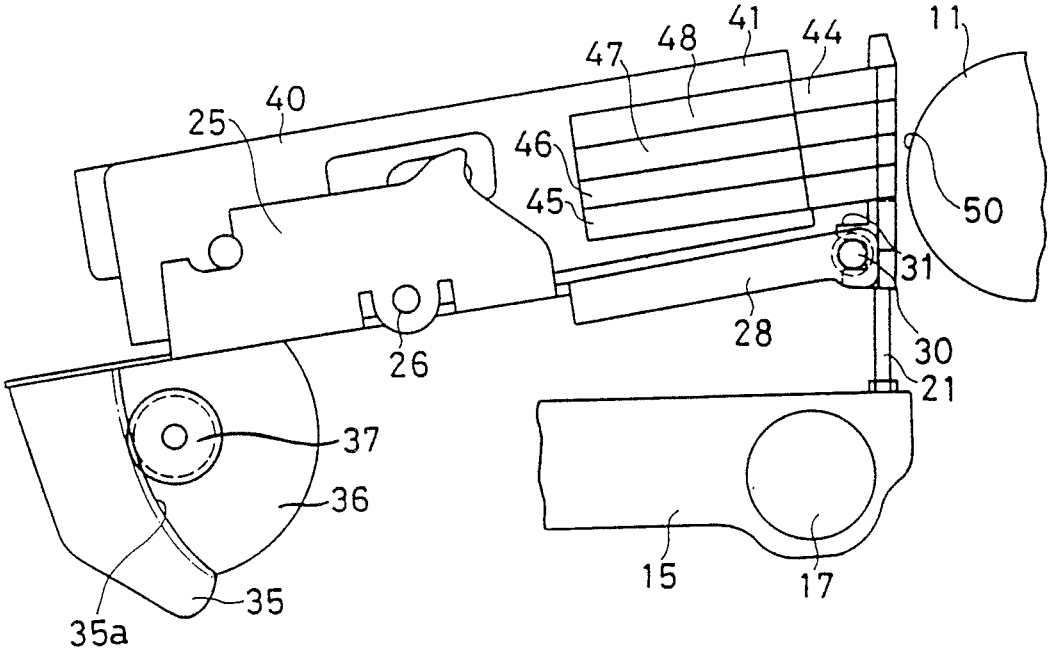
FIG. 6 is a side elevational view indicating the magenta color band out of the plural number (four) of color bands on the ribbon positioned on the printing line.

In the state indicated in FIG. 5 where the black band 48 is positioned on a printing line 50, and for example, a color specification signal specifying the color magenta is input, a predetermined number of pulses are applied to the stepping motor 36 until the magenta band 46 comes onto the printing line 50. By so doing, as indicated in FIG. 6, the stepping motor 36 rotates in the counterclockwise direction and the frame 25 rotates via the gear 37 and the gear portion 35*a*, around the shafts 26 and 27, over a predetermined rotational angle, and stops at that position.

By the above described rotation of the frame 25, firstly the ink ribbon cassette 40 is rotated to the desired position.

Secondly, the shaft 30 moves together with the frame 25 in the counterclockwise direction and pushes the ribbon guide 20 in an upward direction.

The ribbon guide 20 is guided by the studs 21 and 22 to move linearly upwardly. The rotational movement of the shaft 30 is converted into linear movement and causes the ribbon guide 20 to displace in a linear manner so that it is positioned at a predetermined height position.

The ink ribbon 44 at the portion guided by the ribbon guide 20 is shifted together with the ribbon guide 20 in the direction of the width of the ink ribbon, and the magenta band 46 is positioned on the printing line 50 on the platen 11, as indicated in FIG. 6.

The ribbon guide 20 moves along the full length of the platen 11 in the state where the above described height position is maintained by the shaft 30.

In addition, the shaft 30 extends for the full range of the movement of the carrier unit 15. Therefore, the ribbon guide 20 moves up and down by the shaft 30 irrespective of the position of the carrier unit 15.

The following is a description of another embodiment according to the present invention, with reference to FIG. 7 through FIG. 12.

In the figure, those portions that correspond to portions of FIG. 1 through FIG. 6 are indicated with the same numerals, and the corresponding descriptions of them are eliminated.

This embodiment is adapted to compensate for deviation between the height of the ribbon guide 20 and that of the ink ribbon 44 in the ink ribbon cassette 40, which deviation occurs inevitably when the ribbon frame 25 is rotated.

Figure 10A:
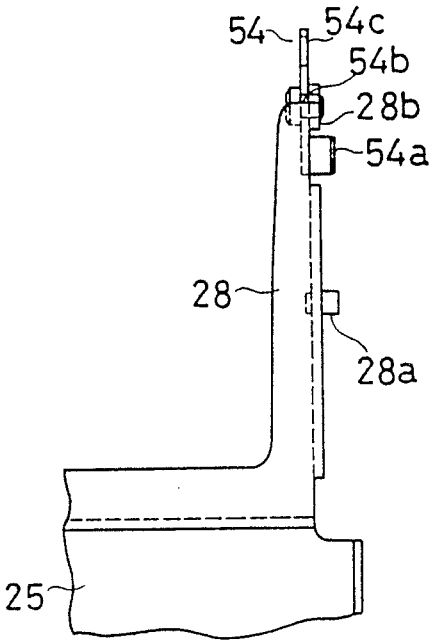
FIGS. 10A and 10B are top and side views, respectively, indicating the turn lever mounted to an arm portion of a frame.
Figure 10B:
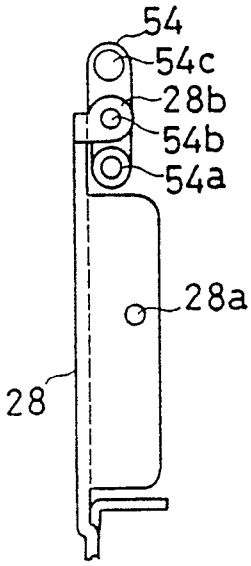

A protrusion 28*a* is provided on the arm portion 28 in FIG. 10A and FIG. 10B. A hole 28*b* is provided at a distal end of the arm portion 28.

Figure 8A:
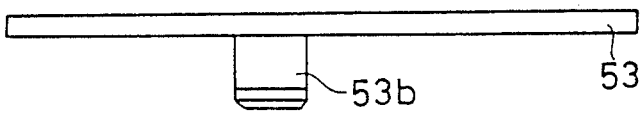
FIGS. 8A and 8B are top and side views, respectively, of a slide lever.
Figure 8B:
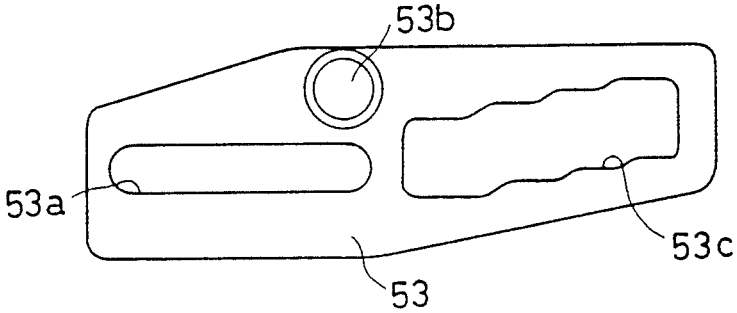

As indicated in FIG. 8A and FIG. 8B, a slide lever 53 has a slide groove 53*a*, a protrusion 53*b* and a stepped groove 53*c*.

Figure 9A:
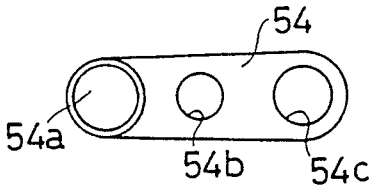
FIGS. 9A and 9B are side and top views, respectively, of a turn lever.
Figure 9B:
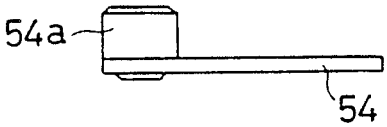

As indicated in FIG. 9A and FIG. 9B, a turn lever 54 has a protrusion 54*a*, a support hole 54*b* and a hole 54*c*.

Figure 7:
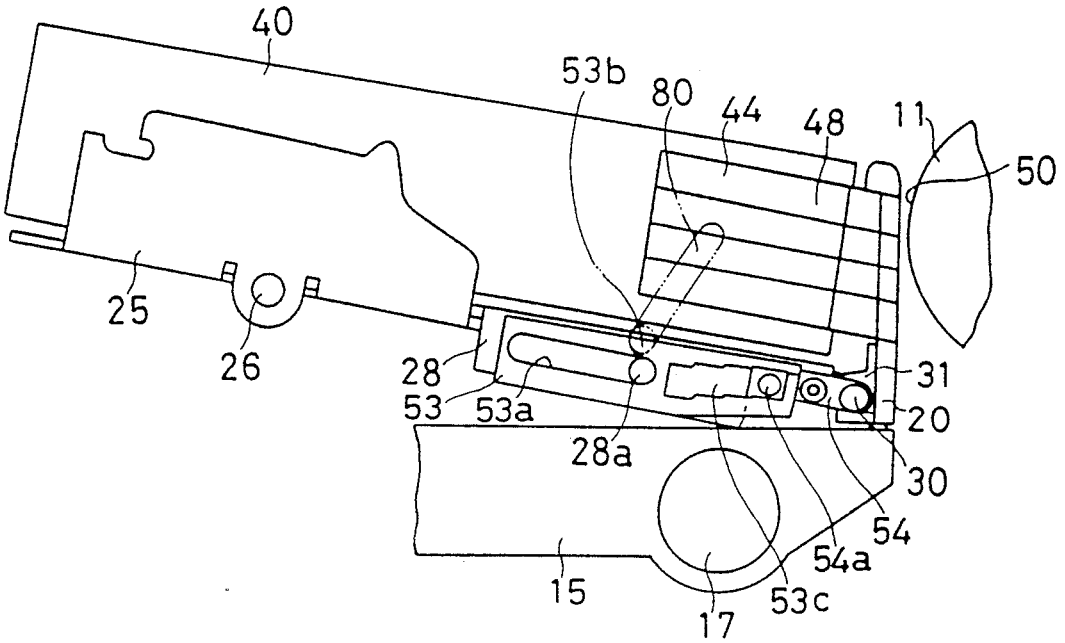
FIG. 7 is a side elevational view of another embodiment of the printer according to the present invention.

The side plate 13*a* (refer to FIG. 2) has formed in it a guide groove 80 as indicated in FIG. 7.

The turn lever 54 is mounted at the hole 54*c* thereof to the mounting hole 28*b* by a nut and bolt, and pivots around the hole 54*b*, as indicated in FIG. 10A and FIG. 10B.

Figure 11A:
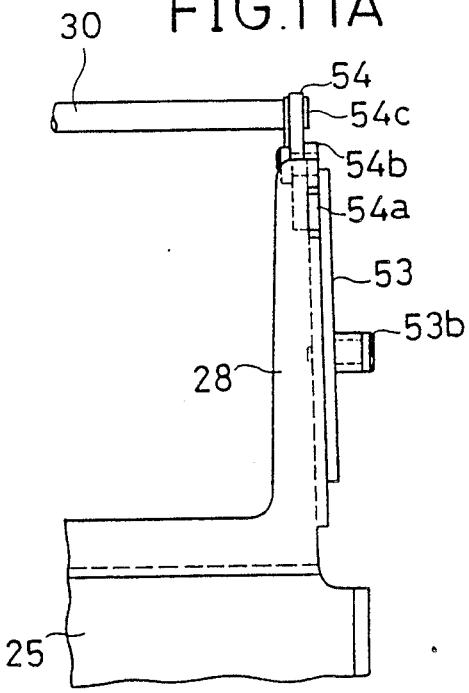
FIG. 11A and 11B are top and side views, respectively, indicating the slide lever mounted.
Figure 11B:
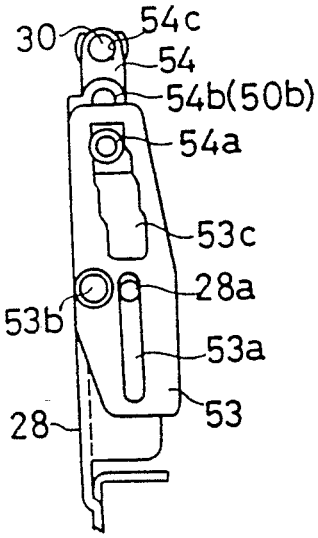

As indicated in FIG. 11A and FIG. 11B, the slide lever 53 is incorporated in such a manner that the slide groove 53*a* engages with the protrusion 28*a* and the stepped groove 53*c* engages with the protrusion 54*a*, and further that the protrusion 53*b* engages with the groove 80.

Accordingly, the slide lever 53 can slide while being regulated by the groove 80 and the slide groove 53*a*. The stepped groove 53*c* controls the rotation with respect to the support hole 54*b* of the turn lever 54.

The shaft 30 is fixed in the hole 54*c* at a distal end of the turn lever 54.

As indicated in FIG. 7, in the state where the uppermost portion (i.e. black band 48) of the ink ribbon 44 corresponds to the printing line 50, the protrusion 53*b* is at the lowermost position of the groove 80, and the slide lever 53 is thereby at the left end with respect to the arm portion 28.

Accordingly, the protrusion 28*a* is at the right end of the groove 53*a*, and the protrusion 54*a* is also at the right end of the groove 53*c*.

Figure 12:
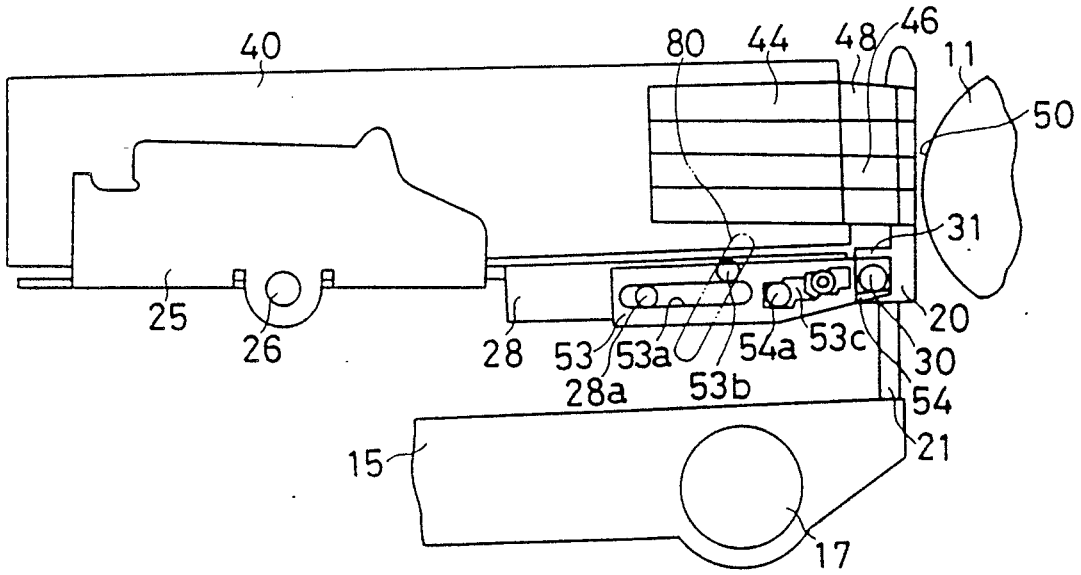
FIG. 12 is a view indicating the magenta color band out of the plural number of color bands on the ribbon positioned on the printing line.

When the ink ribbon cassette support frame 25 is rotated in the counterclockwise direction, as indicated in FIG. 12, the slide lever 53 is regulated by the groove 80 and the protrusion 28*a* and advances in the forward direction of the arm portion 28.

Because of this, the protrusion 54*a* of the turn lever 54 is positioned at a stepped portion of the stepped groove 53*c* corresponding to the amount of movement of the slide lever 53, and the turn lever 54 is thereby rotated in the counterclockwise direction to move the shaft 30 upwardly.

Accordingly, the ribbon guide 20 is moved upwardly by a predetermined amount in which an amount of turning movement of the turn lever 53 is added to an amount of turning movement of the arm portion 28 of the frame 25, and compensation for deviation between the height position of the ink ribbon 44 and that of the ink ribbon guide 20 is therefore performed.

That is, in this embodiment, as the ribbon guide 20 is shifted upwardly, there occurs an insufficiency in the amount of linear movement of the ribbon guide 20 corresponding to the same amount of rotation of the motor 36 (refer to FIG. 3). Accordingly, the embodiment is arranged in such that, as the frame 25 rotates in the counterclockwise direction to swing upwardly, the stepped groove 53*c* lowers the protrusion 54*a* to turn the lever 54 in the counterclockwise direction to raise the shaft 30.

In this embodiment, two levers are provided to perform compensation of the amount of rotational and linear movement, and can be realized with only a slight addition of parts.

According to this embodiment, it is possible to always determine the ideal position of the ribbon guide 20 no matter what position the ink ribbon cassette 40 is in the up and down direction. Accordingly, there is no color slip even in the case where the color bands of the ink ribbon are very narrow.

Moreover, in this embodiment, the shaft 30 is mounted on the ribbon frame 25, but the present invention is not limited to this, for example, the shaft 20 may be attached to the ink ribbon cassette 40 itself. In this case, the ribbon frame 25 described above is no longer necessary and the ink ribbon cassette 40 itself can be swingably supported between the side plates 13*a* and 13*b* of the ink ribbon cassette 40, whereby the ink ribbon cassette 40 itself rotates in accordance with the input of the color specification signals.

In addition, the present invention is not limited to the above embodiment in which there is rotational movement of the ribbon frame, but it can also be configured so that the ribbon frame 25 moves linearly in the up and down direction.

Furthermore, the present invention is not limited to these embodiments, but various variations and modifications may be made without departing from the scope of the present invention.

What is claimed is:

1. A printer having an ink ribbon shift apparatus comprising:

a base unit;

a platen supported substantially horizontally on said base unit;

a carrier unit having a printer head and a ribbon guide, said ribbon guide being movable in the upward and downward directions and said carrier unit being mounted on said base unit to move along said platen;

up and down shift means to shift up and down an ink ribbon cassette having an ink ribbon containing a plurality of color bands of different colors across the direction of its width;

said up and down shift means comprising;

an ink ribbon cassette support frame having an arm portion on each side thereof extending toward said platen, said frame being pivotably supported on said base unit and upon which said ink ribbon cassette is mounted; and a mechanism for pivoting said frame so that said ink ribbon cassette is shifted up and down;

a shaft disposed parallel to said platen and extending along the entire range of movement of said carrier unit; said shaft being attached to and mounted between said frame arm portions and adapted to shift up and down together with said ink ribbon cassette; and an engagement mechanism provided on said ribbon guide to engage said shaft so that free movement of said ribbon guide in the direction of movement of said carrier unit is allowed and free movement in the up and down direction between said ribbon guide and said shaft is restricted;

whereby said up an down shift means moves said ink ribbon cassette up and down, said ribbon guide is thereby shifted up and down via said shaft, and a predetermined color band of said ink ribbon is positioned on a printing line.

2. A printer as recited in claim 1 wherein said mechanism for pivoting said frame comprises:

an arm part attached to said frame, said arm part having a gear portion thereon;

a gear engaging with said gear portion of said arm part; and a stepping motor to rotate said gear.

3. A printer as recited in claim 1 wherein said engagement mechanism comprises:

a pair of spaced, U-shaped cutout portions on said ribbon guide; and a sleeve made of synthetic resin and engaged with each said cutout portion; and said shaft passes through said sleeves.

4. A printer as recited in claim 1 wherein said printer further comprises, on one of said arm portions, a compensation mechanism to compensate a position of height of said ink ribbon guide so as to be in agreement with a position of height of said ink ribbon.

5. A printer as recited in claim 5 wherein said compensation mechanism includes a slide lever and a turn lever operatively connected together and to said arm portion.

* * * * *

UNITED STATES PATENT AND TRADEMARK OFFICE

CERTIFICATE OF CORRECTION

PATENT NO. : 5,064,304

DATED : November 12, 1991

INVENTOR(S) : YOSHIAKI HOSOKAWA, MASAKI KANOH, TAKASHI MAEKAWA and HIROFUMI NAKAYASU It is certified that error appears in the above-identified patent and that said Letters Patent is hereby corrected as shown below:

ON TITLE PAGE: [56] References Cited - FOREIGN PATENT DOCUMENTS
insert --3538761 4/1987 Fed. Rep. of Germany--.

Column 1, line 50, "carridge" should be --carriage--.

Column 3, line 27, "poritions" should be --portions--.

Column 5, line 37, "20" should be --30--.

Column 6, line 25, "an" should be --and--.

Signed and Sealed this

Second Day of March, 1993

*Attest:*

*Attesting Officer*

STEPHEN G. KUNIN

*Acting Commissioner of Patents and Trademarks*